US008562315B2

(12) United States Patent
Inoue et al.

(10) Patent No.: US 8,562,315 B2
(45) Date of Patent: Oct. 22, 2013

(54) FUEL PUMP

(75) Inventors: Hiroshi Inoue, Anjo (JP); Tatsumi Oguri, Okazaki (JP)

(73) Assignee: Denso Corporation, Kariya (JP)

( * ) Notice: Subject to any disclaimer, the term of this patent is extended or adjusted under 35 U.S.C. 154(b) by 763 days.

(21) Appl. No.: 12/355,052

(22) Filed: Jan. 16, 2009

(65) Prior Publication Data

US 2009/0185922 A1 Jul. 23, 2009

(30) Foreign Application Priority Data

Jan. 22, 2008 (JP) ..... 2008-011971

(51) Int. Cl.
*F04B 11/00* (2006.01)

(52) U.S. Cl.
USPC ..... 417/540; 417/413.1

(58) Field of Classification Search
USPC ..... 417/44.2, 44.9, 112, 395, 412, 417/413.1–413.3, 540–544, 394, 478, 479, 417/383, 153, 85, 389, 384; 604/411, 414, 604/415; 92/90, 13 M, 13.2, 50, 394, 32, 92/584
See application file for complete search history.

(56) References Cited

U.S. PATENT DOCUMENTS 4,552,182 A * 11/1985 Graham ..... 138/30
5,120,332 A * 6/1992 Wells ..... 96/146
6,053,208 A 4/2000 Onishi et al.
6,361,284 B2 * 3/2002 Drevet ..... 417/240
7,165,534 B2 1/2007 Usui et al.
7,513,240 B2 * 4/2009 Usui et al. ..... 123/467
2001/0001278 A1 * 5/2001 Drevet ..... 417/222.2
2003/0164161 A1 9/2003 Usui et al.
2005/0019188 A1 1/2005 Usui et al.
2005/0225213 A1 * 10/2005 Richards et al. ..... 310/339
2007/0079810 A1 4/2007 Usui et al.
2007/0107698 A1 5/2007 Usui et al.
2008/0157631 A1 * 7/2008 Heim et al. ..... 310/330
2009/0127356 A1 * 5/2009 Junger et al. ..... 239/585.1
2009/0137940 A1 * 5/2009 Orr ..... 604/6.11
2009/0148320 A1 * 6/2009 Lucas ..... 417/481

FOREIGN PATENT DOCUMENTS

JP 2007-138805 6/2007
JP 2007-309118 11/2007

OTHER PUBLICATIONS

Japanese Office Action dated Dec. 1, 2009, issued in corresponding Japanese Application No. 2008-011971, with English translation.

* cited by examiner

*Primary Examiner* — Anh Mai
*Assistant Examiner* — Fatima Farokhrooz
(74) *Attorney, Agent, or Firm* — Nixon & Vanderhye PC

(57) ABSTRACT

A fuel pump includes a housing having therein a suction passage and a pressurization chamber into which fuel from the suction passage flows, a plunger held in the housing to be reciprocable so as to pressurize the fuel flowing into the pressurization chamber, and a diaphragm device located in a suction chamber that is provided in the suction passage. The diaphragm device includes a pair of first and second diaphragms that are arranged to define an inner space therebetween and air-tightly sealed at its entire peripheries. A mass addition member may be attached to an inside surface of at least one of the first and second diaphragms, so that the first and second diaphragms with the mass addition member have different characteristic frequencies. Accordingly, pressure pulsation of the fuel in the suction chamber can be effectively reduced by the pulsation damper.

25 Claims, 5 Drawing Sheets

FUEL PUMP

CROSS REFERENCE TO RELATED APPLICATION

This application is based on Japanese Patent Application No. 2008-011971 filed on Jan. 22, 2008, the contents of which are incorporated herein by reference in its entirety.

FIELD OF THE INVENTION

The present invention relates to a fuel pump for pressurizing and sending fuel. More particularly, the present invention relates to a damper device provided in the fuel pump.

BACKGROUND OF THE INVENTION

In a fuel pump described in JP-A-2000-193186 (corresponding to U.S. Pat. No. 6,053,208), fuel drawn into a pressurization chamber is pressurized and discharged by using a plunger that is held to be reciprocable in a cylinder of a housing.

In the fuel pump, a single plate metal diaphragm is located in a suction passage connected to the pressurization chamber, and is used as a damper mechanism for reducing a pressure pulsation of the fuel drawn from the suction passage to the pressurization chamber. When the pressure pulsation of the fuel generates and the fuel pressure increases, the diaphragm is elastically deformed by receiving the fuel pressure. For example, the diaphragm is deformed to the outside of the suction passage, so that the volume of the suction passage is increased. Thus, an increase of the fuel pressure in the suction passage can be restricted thereby reducing the vibration width of the pressure pulsation.

In a diaphragm device of a fuel pump described in JP-A-2005-042554 (corresponding to US 2007/0079810 A1), a metal diaphragm device is constructed by welding the whole peripheries of two metal diaphragms, and is fixed into a suction passage, in order to increase the reduction effect of the pressure pulsation.

In the diaphragm device of the fuel pump described in JP-A-2005-042554, a sealed space is formed by using the two metal diaphragms. In this case, when the pressure pulsation of fuel generates and the fuel pressure increases, the two metal diaphragms are elastically deformed at the same time by receiving the fuel pressure, and the diaphragm device is bent. Thus, an increase amount in the volume of the suction passage and the reduction effect of the pressure pulsation can be increased as compared with a fuel pump using a single metal diaphragm.

In the diaphragm device of JP-A-2005-042554, the sectional shapes of the two metal diaphragms are made uneven to be different from each other so that the two metal diaphragms have different characteristic frequencies. Accordingly, even when the frequency of the pressure pulsation is changed due to variation in a rotation speed of an engine and becomes to be equal to the characteristic frequency of one of the two metal diaphragms, the reduction effect of the pressure pulsation can be obtained on the other one of the two metal diaphragms.

However, because the two metal diaphragms having different uneven shapes in cross section are provided in the diaphragm device of the fuel pump, the product cost of the fuel pump is increased. The frequency of the pressure pulsation is changed in accordance with the engine type or the vehicle type to which the fuel pump is mounted. Therefore, it is necessary to prepare various kinds of the uneven metal diaphragms in accordance with the engine type and the vehicle type, thereby more increasing the product cost.

SUMMARY OF THE INVENTION

In view of the foregoing problems, it is an object of the present invention to provide a fuel pump having a diaphragm device with two metal diaphragms, in which the reduction effect of the pressure pulsation of the two metal diaphragms can be effectively obtained even when the frequency of the pressure pulsation is changed.

It is another object of the present invention to provide a fuel pump having a diaphragm device with two metal diaphragms, in which the reduction effect of the pressure pulsation of the two metal diaphragms can be effectively obtained without increasing the product cost, even when the frequency of the pressure pulsation is changed.

According to an aspect of the present invention, a fuel pump includes: a housing having therein a suction passage through which fuel is drawn and a pressurization chamber into which the fuel from the suction passage flows; a plunger held in the housing to be reciprocable and configured to pressurize the fuel flowing into the pressurization chamber; and a diaphragm device located in a suction chamber that is provided in the suction passage. The diaphragm device includes a pair of first and second diaphragms that are arranged to define an inner space therebetween and air-tightly sealed at its entire peripheries, and a mass addition member attached to an inside surface of at least one of the first and second diaphragms. For example, the first and second diaphragms are made of metal, and generally have the same shape and the same thickness.

Because the mass addition member is attached to the inside surface of at least one of the first and second diaphragms, it is possible for the first and second diaphragms with the mass addition member to have different characteristic frequencies. Accordingly, when the pulsation frequency of pressure pulsation of the fuel in the suction chamber is different from both the first and second diaphragms in a case where the fuel pressure is increased, both the first and second diaphragms are deformed inside, so as to increase the volume of the suction passage and reduce the pressure pulsation. When the pulsation frequency of pressure pulsation of the fuel in the suction chamber becomes equal to any one of the first and second diaphragms, the other one of the first and second diaphragms does not resonate thereby having the reduction effect of the pressure pulsation. As a result, even when the pulsation frequency of the pressure pulsation of the fuel in the suction chamber is changed, the reduction effect of the pressure pulsation of the fuel can be effectively obtained by the diaphragm device. In the diaphragm device, by changing the weight of the mass addition member, a difference between the characteristic frequencies of the first and second diaphragms with the mass addition member can be easily set. In addition, when the first and second diaphragms have the same shape in cross section, the size increase and the cost increase in the fuel pump can be restricted.

For example, the mass addition member is made of a material having flexibility more than a predetermined degree. Generally, the predetermined degree of the flexibility in the mass addition member is set such that a deformation (spring characteristic) of the first and second diaphragms is not restricted by the mass addition member. Therefore, even when the mass addition member is attached to the first and second diaphragms, the reduction effect of the pressure pulsation of the fuel can be effectively obtained by the diaphragm device.

Alternatively, the mass addition member may be a metal film that is bonded to the inside surface of at least one of the first and second diaphragms via an adhesive that has flexibility more than a predetermined degree. Even in this case, the predetermined degree of the flexibility in the adhesive can be set such that a deformation (spring characteristic) of the first and second diaphragms is not restricted by the adhesive.

According to another aspect of the present invention, a fuel pump includes: a housing having therein a suction passage through which fuel is drawn and a pressurization chamber into which the fuel from the suction passage flows; a plunger held in the housing to be reciprocable and configured to pressurize the fuel flowing into the pressurization chamber; and a diaphragm device located in a suction chamber that is provided in the suction passage. The diaphragm device includes a pair of first and second diaphragms that are arranged to define an inner space therebetween and are air-tightly sealed at its entire peripheries. Furthermore, the first and second diaphragms are made of metal, and generally have the same thickness while having different shapes in cross section. Accordingly, it is possible for the first and second diaphragms to have different characteristic frequencies.

For example, the first diaphragm has a circular deformable portion and a peripheral end portion at a radial outside of the circular deformable portion, and the circular deformable portion of the first diaphragm has a plurality of concentric grooves that are recessed toward the inner space of the diaphragm device so as to have a wave shape in cross section. Alternatively, the second diaphragm has a circular deformable portion and a peripheral end portion at a radial outside of the circular deformable portion, and the circular deformable portion of the second diaphragm has a flat shape in cross section.

Accordingly, even when the pulsation frequency of pressure pulsation of the fuel in the suction chamber becomes equal to any one of the first and second diaphragms, the other one of the first and second diaphragms does not resonate thereby having the reduction effect of the pressure pulsation. As a result, even when the pulsation frequency of the pressure pulsation of the fuel in the suction chamber is changed, the reduction effect of the pressure pulsation of the fuel can be effectively obtained by the diaphragm device. In the diaphragm device, a difference between the characteristic frequencies of the first and second diaphragms can be easily set.

Even in this case, a mass addition member may be attached to an inside surface of at least one of the first and second diaphragms. Furthermore, the mass addition member may be made of a material having flexibility equal to or more than a predetermined degree, or the mass addition member may be a metal film that is bonded to the inside surface of at least one of the first and second diaphragms via an adhesive that has flexibility more than a predetermined degree.

According to another aspect of the present invention, a fuel pump includes: a housing having therein a suction passage through which fuel is drawn and a pressurization chamber into which the fuel from the suction passage flows; a plunger held in the housing to be reciprocable so as to pressurize the fuel flowing into the pressurization chamber; and a diaphragm device located in a suction chamber that is provided in the suction passage. The diaphragm device includes a pair of first and second diaphragms that are arranged to define an inner space therebetween and are air-tightly sealed at its entire peripheries, and the first and second diaphragms generally have different thicknesses in cross section while having the same outer shape. Accordingly, the first and second diaphragms can be easily configured to have, respectively, characteristic frequencies which are different from each other by only setting the thicknesses of the first and second diaphragms different from each other. As a result, the reduction effect of the pressure pulsation of the fuel can be effectively obtained by the diaphragm device while the production cost of the diaphragm device can be reduced.

For example, each of the first and second diaphragms has a circular deformable portion and a peripheral end portion at a radial outside of the circular deformable portion, and the circular deformable portion of each of the first and second diaphragms has a flat shape in cross section.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Preferred embodiments and modifications thereof according to the present invention will be described below.

First Embodiment

Figure 1:
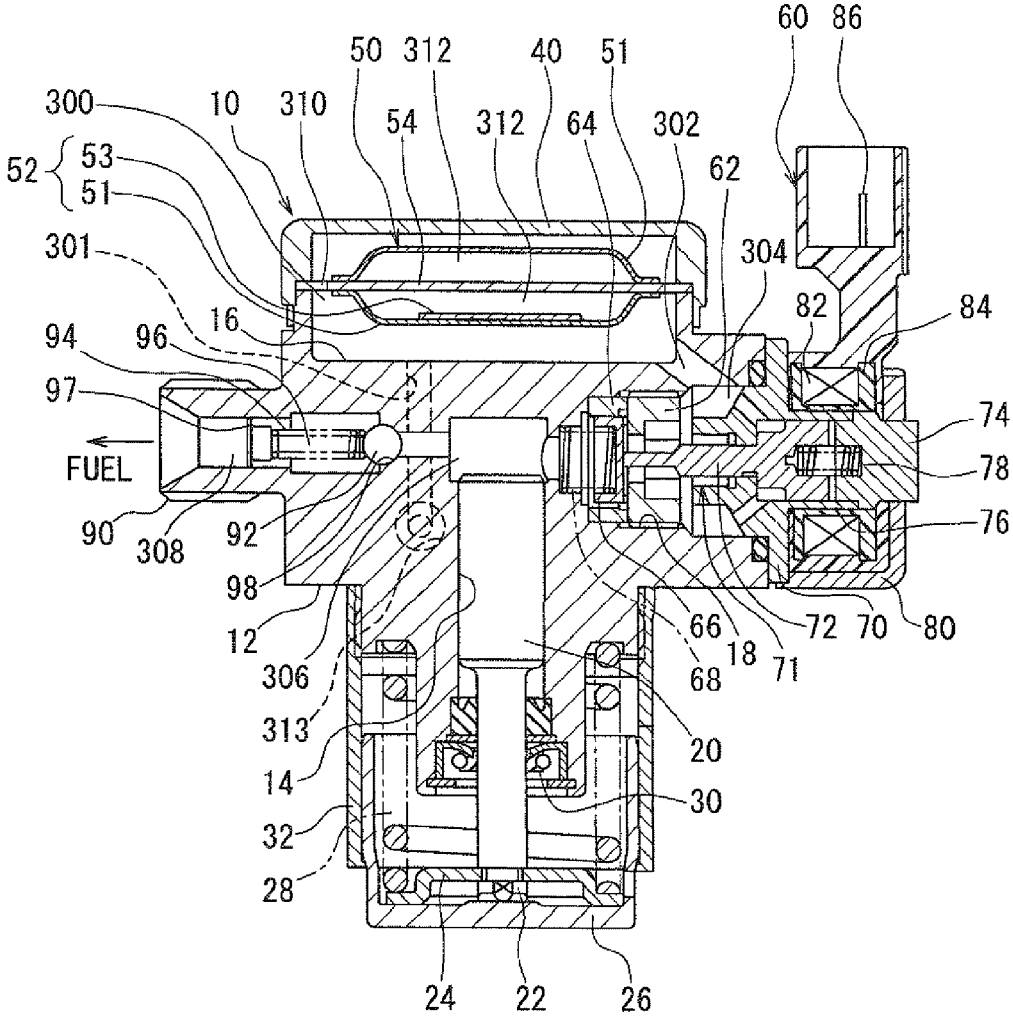
FIG. 1 is a schematic sectional view showing a fuel pump according to a first embodiment of the present invention.

FIG. 1 shows an example of a high-pressure fuel pump 10 according to a first embodiment of the present invention. The fuel pump 10 is a fuel supply pump configured to supply fuel to an injector of a diesel engine or a gasoline engine, for example. The fuel pump 10 has a fuel passage portion from a fuel inlet (not shown) to a discharge portion 90 that is used as a fuel outlet. The fuel passage portion from the fuel inlet to the discharge portion 90 includes a suction chamber 300, a fuel communication passage 302, a fuel gallery 304, a pressurization chamber 306 and a discharge passage 308. A suction passage for drawing the fuel into the pressurization chamber 306 includes the suction chamber 300, the fuel passage 302 and the fuel gallery 304.

The housing body 12 is formed integrally by using an iron material such as martensitic stainless steel, for example. The housing body 12 is configured to have a cover 40 and a pump housing of the fuel pump 10. The cover 40 is fitted to the pump housing of the fuel pump 10 so as to form the housing body 12.

A plunger 20 is held to be reciprocable in a cylinder 14 that is formed integrally with the housing body 12. The pressurization chamber 306 is provided at one end side of the plunger 20 in a reciprocating direction of the plunger 20. An oil seal 30 is configured to seal an outer peripheral surface of a sliding portion of the plunger 20 between the cylinder 14 and a head 22. The oil seal 30 is configured to prevent a flow of oil from the engine to the pressurization chamber 306 and a flow from the pressurization chamber 306 into the engine. The head 22 formed at the other end side of the plunger 20 is connected to a spring seal 24. The spring seat 24 is pressed and fixed to an inner wall of a bottom portion of a tappet 26 by using load of a spring 28. An outer wall portion of the bottom portion of the tappet 26 is made to be slidable by rotation of a pump cam (not shown), so that the plunger 20 reciprocates together with the tappet 26. A tappet guide 32 is formed into a cylindrical shape, and is screwed and connected to an outer periphery of the housing 12. The tappet guide 32 is configured to accommodate the tappet 26 on its inner peripheral side and to hold the tappet 26 to be reciprocable in the tappet guide 32.

A fuel inlet port 313 is provided in the housing body 12, and is used as an introduction port of fuel that is sent by a low pressure pump (not shown) from a fuel tank (not shown) outside of the fuel pump 10, for example. The suction passage for introducing the fuel from the fuel inlet port 313 to the pressurization chamber 306 is provided in the housing body 12, and includes a fuel communication passage 301, the suction chamber 300, the communication passage 302 and the fuel gallery 304. The communication passage 301, the suction chamber 300, the communication passage 302 and the fuel gallery 304 are provided in the housing body 12, in this order, in the suction passage from the fuel inlet port 313 to the pressurization chamber 306.

A recess portion 16 is formed in the housing body 12, so that the suction chamber 300 is defined by the recess portion 16 and the cover 40 in the housing body 12. The suction chamber 300 is provided approximately at an extension line of the plunger 20 in an axial direction at an opposite side of the plunger 20 with respect to the pressurization chamber 306, and expands radially outside more than the pressurization chamber 306 in a radial direction perpendicular to the axial direction. In the example of FIG. 1, the fuel from the fuel inlet port 313 flows into the suction chamber 300 positioned at a lower part of a pulsation damper 50 (diaphragm device) via the communication passage 301. Furthermore, the fuel in the suction chamber 300 flows into the fuel gallery 304 via the communication passage 301. An electromagnetic valve 60 is located to communicate or interrupt a passage between the fuel gallery 304 and the pressurization chamber 306 from the suction passage. That is, the electromagnetic valve 60 is configured to switch between a supply and an interruption of the fuel flowing into the pressurization chamber 306. The electromagnetic valve 60 includes a valve member 66 that is located between the fuel gallery 304 and the pressurization chamber 306, as shown in FIG. 1.

Figure 2:
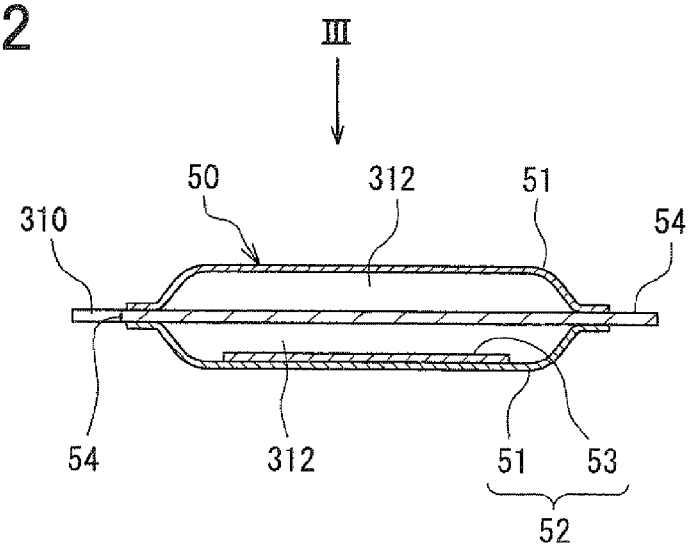
FIG. 2 is a cross sectional view taken along the line II-II of FIG. 3, showing a pulsation damper (diaphragm device) of the fuel pump, according to the first embodiment.
Figure 3:
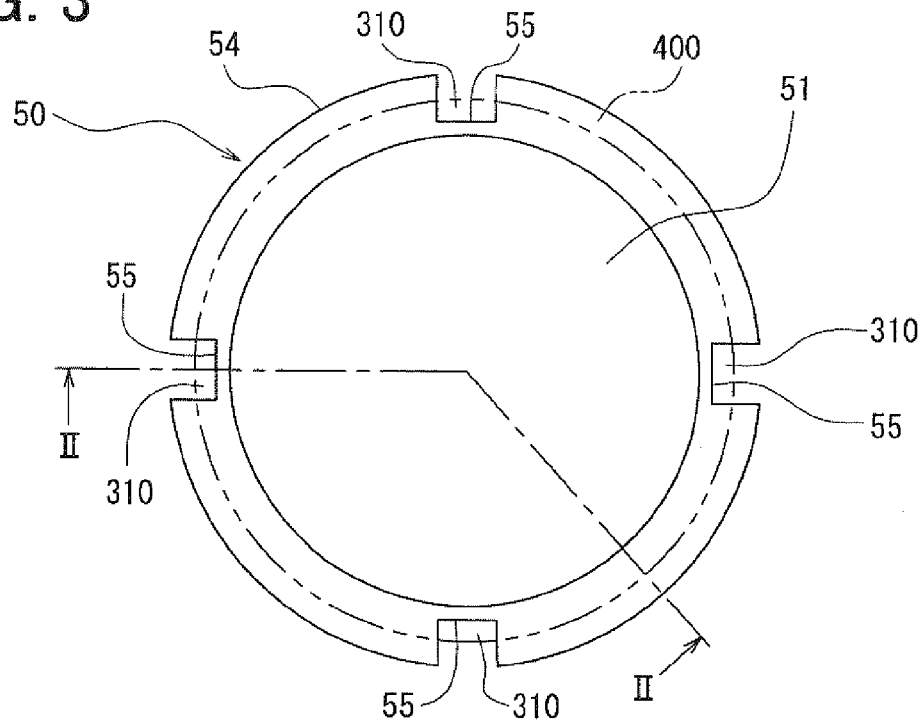
FIG. 3 is a plan view showing the pulsation damper of the fuel pump when being viewed from the arrow III of FIG. 2, according to the first embodiment.

The pulsation damper 50 is a diaphragm device of the present embodiment. As shown in FIG. 1, the pulsation damper 50 is inserted between the cover 40 and the pump housing of the housing body 12. As shown in FIGS. 2 and 3, the pulsation damper 50 includes a circular plate 54, and two circular diaphragms 51, 52 located at two sides of the plate 54 in a thickness direction of the plate 54. More specifically, the diaphragm 51 is made of metal and is located at one side of the plate 54 (e.g., at an upper side of the plate 54 in FIG. 2). The diaphragm 52 constructed with another diaphragm 51 and a resin film 53 is located at the other side of the plate 54 (e.g., at a lower side of the plate 54 in FIG. 2). For example, the diaphragm 51 is formed by pressing a thin plate made of a stainless steel, and an entire periphery of the diaphragm 51 is welded to the plate 54 by using a laser welding or the like to be air-tightly fixed to the plate 54. The diaphragm 52 is constructed with a diaphragm similar to the diaphragm 51 made of metal, and the resin film 53 that is attached onto an inner surface of the diaphragm 51 to opposite to the inner surface of another diaphragm 51. The resin film 53 is used as a mass addition member, and is attached to the inner surface of the diaphragm 51 to face the plate 54 so as to construct the diaphragm 52. An entire peripheral portion of the diaphragm 52 that is constructed with the diaphragm 51 and the resin film 53 bonded to the diaphragm 51 is welded to the plate 54 by using a laser welding or the like. Therefore, the entire peripheral portions of the diaphragm 51 and the diaphragm 52 are air-tightly sealed while the plate 54 is inserted between the diaphragm 51 and the diaphragm 52. Accordingly, an inner space within the pulsation damper 50 is completely shut from the fuel within the suction chamber 300.

The resin film 53 is made of a resin having a flexibility and can be formed by coating, for example. For example, the resin material of the resin film 53 is a silicone resin, a fluorine resin, a polyurethane resin or the like. As shown in FIG. 3, rectangular recess portions 55 are provided at outer peripheral portion of the plate 54 at an interval of 90° so as to define the communication passage 310. The plate 54 has an insertion portion 400 that is located radial outside of the communication passage 310, and is inserted between the pump housing and the cover 40 of the housing body 12. In the state shown in FIG. 1 where the plate 54 is inserted between the pump housing and the cover 40 of the housing body 12, the communication passage 310 communicates with the suction chamber 300 on the two sides in the thickness direction of the plate 54. Thus, the fuel communicates with each other between the two sides of the pulsation chamber 50 within the suction chamber 300 in the thickness direction of the plate 54, thereby preventing the fuel from staying on the one side in the suction chamber 300.

A damper chamber 312 is formed between the plate 54 and the diaphragm 51, and a damper chamber 312 is also formed between the plate 54 and the diaphragm 52. That is, an inner space of the pulsation damper 50 is partitioned into the two damper chambers 312 on the two sides of the plate 54. Within the damper chamber 312, noble gas such as He, N2 or the like is sealed by a predetermined pressure. That is, noble gas is used as a sealing gas of the damper chamber 312. The sealed gas pressure can be set to be equal in the two damper chambers 312 by filling the two damper chambers 312 with the gas under the same atmosphere and condition, or can be set to be different from each other between the two damper chambers 312 by filling the gas in different steps or/and different conditions.

The plate thickness of the diaphragm 51 is set in accordance with an outer diameter of the diaphragm 51, a pulsation decrease characteristic and the like. Generally, the outer diameter of the diaphragm 51 is determined based on the dimension of the plate 54. In the first embodiment, the outer diameter of the plate 54 can be set in a range between 20 mm and 40 mm. When the outer diameter of the plate 54 is set in the range between 20 mm and 40 mm, the thickness "t" of the diaphragm 51 is set to be not smaller than 0.2 mm and to be not larger than 0.3 mm. That is, 0.2 mm≤t≤0.3 mm. The diaphragms 51, 52 are elastically deformed in accordance with a variation in the fuel pressure of the suction chamber 300 so as to reduce pressure pulsation of the fuel in the suction chamber 300. In the first embodiment, the one diaphragm 51 at the one side of the plate 54 is generally the same as the other diaphragm 51 (metal part) used in the diaphragm 52 at the other side of the plate 54.

A fuel pressure in the suction chamber 300 is changed by the pulsation damper 50, so as to reduce the pressure pulsation. Next, the reduction effect of the pressure pulsation due to the pulsation damper 50 will be described.

When the fuel pressure in the suction chamber 300 is increased in a case where the pressure pulsation generates, the diaphragms 51, 52 are elastically deformed toward the plate 54. That is, the diaphragms 51, 52 are deformed to be closer to the plate 54 so that the pulsation damper 50 is deformed and is recessed inside. Thus, the volume of the pulsation damper 50 is reduced and an inner space enclosed by the diaphragms 51, 52 is reduced, and thereby an actual capacity of the suction chamber 300 in which the fuel is filled is relatively increased. Accordingly, it can restrict a pressure increase due to the pressure pulsation.

Next, when the fuel pressure in the suction chamber 300 is decreased in a case where the pressure pulsation generates, the diaphragms 51, 52 are elastically deformed toward outside. That is, the diaphragms 51, 52 are deformed to be far from the plate 54 so that the pulsation damper 50 is deformed and is expanded outside. Thus, the volume of the pulsation damper 50 is increased and an inner space enclosed by the diaphragms 51, 52 is increased, and thereby an actual capacity of the suction chamber 300 in which the fuel is filled is relatively decreased. Accordingly, it can restrict a pressure reduction due to the pressure pulsation. As a result, the fuel pressure pulsation in the suction chamber 300 can be effectively reduced.

As shown in FIG. 1, the electromagnetic valve 60 is configured to open and close the fluid passage between the fuel gallery 304 and the pressurization chamber 306 by switching an electrical current supplied to a coil 82. In the first embodiment, the electromagnetic valve 60 is a fuel adjustable valve which can adjust a fuel discharge amount of the fuel pump 10 by controlling current supply timing to the coil 82. As shown in FIG. 1, the fuel gallery 304 is provided to communicate with the suction chamber 300 via the fuel passage 302.

Next, the structure of the electromagnetic valve 60 will be described. A seat member 62 of the electromagnetic valve 60 is screwed with and connected to a recess portion 18 of the housing body 12, and a guide member 64 of the electromagnetic valve 60 is pushed into the bottom surface of the recess portion 18. The guide portion 64 is provided in the electromagnetic valve 60 to guide and support the valve member 66 in reciprocable. Therefore, the valve member 66 can be movably attached by the guide portion 64 to be reciprocated. A spring portion 68 is attached to the valve member 66 to apply a load to the valve member 66 in a direction toward the seat member 62. When the valve member 66 seats on the seat member 62, the communication between the fuel gallery 304 and the pressurization chamber 306 is interrupted.

The valve body 70 is made of an electromagnetic material, and a movable core 72 is held in the valve body 70 to be reciprocated along a guide member 71. A fixed core 74 is located at one end side of the movable core 72, and the other end side of the movable core 72 extends toward the valve member 66 to be opposite to the one end side. A non-magnetic member 76 is formed into approximately a cylindrical shape, and is located between the valve body 70 and the fixed core 74. Therefore, the non-magnetic member 76 prevents a short of magnetic flux between the valve body 70 and the fixed core 74. A spring 78 is located between the movable core 72 and the fixed core 74 such that a load is applied to the movable core 72 toward the valve member 66. Generally, the load of the spring 78 is set larger than the load of the spring 68. A yoke 80 is located to cover the outer periphery of the coil 82 and to magnetically connect the fixed core 74 and the valve body 70 to each other. In the electromagnetic valve 60, the movable core 72, the fixed core 74 and the yoke 80 are configured to form an electromagnetic circuit.

The coil 82 is wound onto a bobbin 84. The movable core 72 and the fixed core 74 are coupled via the spring 78 to have a gap between the movable core 72 and the fixed core 74. The bobbin 84 and the coil 82 are located around the outer periphery of the movable core 72 and the fixed core 74. A terminal 86 is electrically connected to the coil 82 so that electrical power is supplied from the terminal 86 to the coil 82.

Because the load of the spring 78 is set larger than the load of the spring 68, the end portion of the movable core 72 protrudes toward the valve member 66 from the seat member 62 to contact the valve member 66 when electrical current applied to the coil 82 is turned off as in the state of FIG. 1. In this state, the valve member 66 is separated from the seal member 62 so that the fuel gallery 304 communicates with the pressurization chamber 306. On the other hand, when the electrical current supplied to the coil 82 is turned on, a magnetic adsorption force is activated between the movable core 72 and the fixed core 74 so that the movable core 72 is moved toward the fixed core 74 against to the load difference between the spring 78 and the spring 68. In the example of FIG. 1, the movable core 72 is moved toward the right side. Therefore, the valve member 66 seats on the seal member 62 by the load of the spring 68, thereby shut the communication between the fuel gallery 304 and the pressurization chamber 306.

The discharge portion 90 is used as a joint to be joined with a high pressure pipe and is also used as a delivery valve. The discharge passage 308 through which the pressurized fuel is discharged is provided in the discharge portion 90. A ball 92, a spring 94, a spring seat 96 and a C-ring 97 are accommodated in the discharge passage 308. A valve seat 98 on which the ball 92 is made to be seated is formed in the housing body 12. One end of the spring 94 is connected to the spring seat 96, and the other end of the spring 94 is connected to the ball 94.

Thus, the spring 94 can apply a load to the ball 94 in a direction toward the valve seat 98. The spring seat 96 is connected to the spring 94 at its one end, and has a rod portion extending toward the ball portion 92. The rod portion of the spring seat 96 is configured to regulate a lift amount of the ball 92. The C-ring 97 is fitted into a circular groove formed in an inner peripheral wall of the housing body 12 so that it can prevent the spring seat 96 from being removed from the discharge passage 308.

When the ball 92 is seated on the valve seat 98, a communication between the pressurization chamber 306 and the discharge passage 308 is shut. In contrast, when the pressure of the pressurization chamber 306 becomes equal to or more than a predetermined pressure, the ball 92 is separated from the valve seat 98 against to the load of the spring 94, and the high-pressure fuel in the pressurization chamber 306 is discharged from the discharge portion 90 via the discharge passage 308.

Next, operation of the fuel pump 10 according to the first embodiment will be described.

(1) Suction Stroke (Suction Operation)

When the plunger 20 is moved downwardly in FIG. 1 from the top dead point to the bottom dead point, electrical current applied to the coil 82 is turned off. Therefore the valve member 66 is pressed from the movable core 72 toward the pressurization chamber 306 by the load difference between the spring 78 and the spring 68. Thus, the valve member 66 is lifted from the seat member 62. Furthermore, when the plunger 20 moves downwardly in FIG. 1, the pressure of the pressurization chamber 306 is decreased. Therefore, the force applied to the valve member 66 from the fuel of the fuel gallery 304 becomes larger than the force applied to the valve member 66 from the fuel of the pressurization chamber 306. Accordingly, the valve member 66 receives a force for separating the valve member 66 from the seat member 62, by the load difference between the spring 68 and the spring 78 and the pressure difference between the fuel gallery 304 and the pressurization chamber 306, and thereby the valve member 66 is separated from the seat member 62. In this case, the fuel in the suction chamber 300 is drawn into the pressurization chamber 306, via the fuel passage 302 and the fuel gallery 304.

A pressure pulsation of the fuel drawn from the suction chamber 300 into the pressurization chamber 306 is caused, by pressure pulsation of the fuel supplied to the suction chamber 300 from a low pump (not shown) and pressure pulsation of the fuel returning from the pressurization chamber 306 to the suction chamber 300 in the next stroke. In the first embodiment, because the pulsation damper 50 is located in the suction chamber 300, the diaphragms 51, 52 are deformed and displaced in accordance with the variation in the pressure of the suction chamber 300, and thereby the pressure pulsation of the fuel to be drawn into the pressurization chamber 306 can be reduced.

(2) Return Stroke (Return Operation)

Even when the plunger 20 is moved from the bottom dead point to the top dead point, the off state of electrical current to the coil 82 is maintained. Thus, the valve member 66 is pressed toward the pressurization chamber 306 from a side of the movable core 72 by the load difference between the spring 78 and the spring 68. As a result, in accordance with the upward movement of the plunger 20, the fuel in the pressurization chamber 306 returns to the suction chamber 300 through the fuel gallery 304 and the fuel passage 302.

In the return stroke pressure pulsation may be caused in the fuel returning to the suction chamber 300 from the pressurization chamber 306. However, in the first embodiment, the pulsation can be reduced by the pulsation damper 50 located in the suction chamber 300, thereby effectively restricting a transmission of the pulsation to a downstream side of the suction chamber 300.

When electrical current applied to the coil 82 is turned on during the return stroke, magnetic force is generated between the movable core 72 and the fixed core 74. By the magnetic adsorption force between the movable core 72 and the fixed core 74, the movable core 72 is moved toward the fixed core 74 against to the load difference between the spring 78 and the spring 68. When the movable core 72 is adsorbed toward the fixed core 74 and is moved toward the fixed core 74, the valve member 66 is separated from the movable core 72 and seats on the seat member 62 by the load of the spring 68. When the valve member 66 is seated onto the seat member 62, the communication between the fuel gallery 304 and the pressurization chamber 306 is shut, and the return stroke for returning the fuel from the pressurization chamber 306 to the suction chamber 300 is finished. By adjusting electrical supply time to the coil 82 in the return stroke, the fuel amount returning from the pressurization chamber 306 to the suction chamber 300 can be adjusted. As a result, a fuel amount pressurized in the pressurization chamber 306 can be adjusted, and a discharge amount of the fuel discharged from the discharge portion 90 can be adjusted.

(3) Pressurization Stroke (Pressurization Operation)

When the plunger 20 is moved upwardly to the top dead point in a state where the communication between the fuel gallery 304 and the pressurization chamber 306 is shut, the fuel in the pressurization chamber 306 is pressurized so as to increase the fuel pressure in the pressurization chamber 306. Then, when the fuel pressure of the pressurization chamber 306 is increased to be equal to or higher than the predetermined pressure, the ball 92 is lifted from the valve seat 98 against to the load of the spring 94. Therefore, the high-pressure fuel pressurized in the pressurization chamber 306 is discharged from the discharge portion 90 via the discharge passage 308. The fuel discharged from the discharge portion 90 is supplied to a fuel rail (not shown) to be stored therein, and is supplied to a fuel injection valve (not shown), for example.

By repeating the above strokes, the fuel pump 10 causes the drawn fuel to be pressurized to the predetermined pressure.

According to the first embodiment of the present invention, the fuel pump 10 is provided with the pulsation damper 50 that is located in the suction chamber 300. The pulsation damper 50 includes a pair of diaphragms 51 and the resin film 53. The resin film 53 is attached to an inner surface of one diaphragm 51 so as to form the diaphragm 52, as shown in FIG. 2. The plate 54 is inserted between the other diaphragm 51 and the diaphragm 52, as shown in FIG. 2. Next, the operation effect of the pulsation damper 50 will described.

The pulsation in the fuel pressure within the suction chamber 300 of the fuel pump 10 corresponds to a variation in the fuel pressure within the suction chamber 300. The pressure pulsation in the suction chamber 300 is caused because the fuel pressurization is intermittently performed at intervals due to the reciprocation movement of the plunger 20. Furthermore, the pressure pulsation in the suction chamber 300 is changed in accordance with the dimensions (e.g., inner diameter, length) of a fuel supply passage through which the fuel in the fuel tank (not shown) is supplied to the fuel pump 10. Furthermore, the plunger 20 is driven by a crank of the engine so as to perform the reciprocation movement in the plunger 20. Therefore, the fuel pressurizing cycle due to the plunger 20 and pulsation frequency of the fuel pressure pulsation in the suction chamber 300 are also changed in accordance with the rotation speed of the engine.

In the first embodiment, because the diaphragm 52 is formed by bonding the resin film 53 onto the inner surface of the diaphragm 51, the diaphragm 51 on the one side of the plate 54 has a characteristic frequency different from that of the diaphragm 52 on the other side of the plate 54. Because the characteristic frequencies of both the diaphragm 51 and the diaphragm 52 are different from each other, resonance in both the diaphragms 51 and 52 can be restricted.

Figure 4:
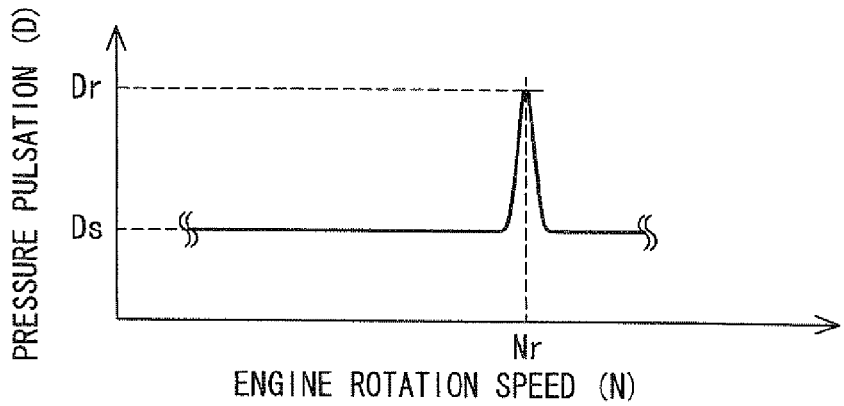
FIG. 4 is a graph showing the relationship between a dimension (D) of a fuel pressure pulsation (i.e., a variation width of the pressure pulsation) in a suction chamber of a comparison fuel pump, and an engine rotation speed (N)

FIG. 4 is a graph showing the relationship between dimension D (variation width) of the pressure pulsation and the engine rotational speed (N) in a comparison fuel pump in which a pulsation damper (damper device) is constructed with a pair of metal diaphragms having the same characteristic frequency without a mass addition member. That is, in the comparison example of FIG. 4, the material, the shape of the two diaphragms are the same so that both the diaphragms have the same characteristic frequency. In this case, when pulsation frequency of the fuel pressure pulsation in the suction chamber of the fuel pump becomes equal to the characteristic frequency of the metal diaphragms, both the metal diaphragms resonate, and thereby the reduction effect in the pressure pulsation of the metal diaphragms of the pulsation damper is greatly reduced. Thus, the fuel pressure pulsation in the suction chamber is not reduced in the example of FIG. 4, and noise may be generated from the fuel supply passage of the fuel pump.

In a normal rotation speed area of the engine, the dimension D (variation width) of the fuel pressure pulsation in the suction chamber becomes Ds shown in FIG. 4. In contrast, when engine rotation speed N is a rotation speed Nr, the pulsation frequency of the fuel pressure pulsation in the suction chamber becomes the same as the characteristic frequency of the metal diaphragms, thereby generating the resonance of the metal diaphragms. Thus, the reduction effect of the pressure pulsation due to the pulsation damper is greatly reduced, so that the fuel pressure pulsation is rapidly increased to Dr.

In the fuel pump 10 according to the first embodiment of the present invention, the pulsation damper 50 includes the two diaphragms 51 and 52 having different characteristic frequencies. In addition, the diaphragm 52 is constructed of the metal diaphragm 51 and the resin film 53 bonded onto the inside surface of the metal diaphragm 51. That is, the metal part of the diaphragm 52 is the same as another diaphragm 51 in the shape and weight. Because the resin film 53 is formed on the inside surface of the metal diaphragm 51, the total weight of the diaphragm 52 is larger than that of the diaphragm 51.

The characteristic frequency of the diaphragm is generally determined based on the spring characteristic and the weight of the diaphragm. Because the thin resin film 53 provided in the diaphragm 52 is flexible, the spring characteristic of the diaphragm 51 that is the metal part of the diaphragm 52 is generally not affected due to the thin resin film 53. Thus, the spring characteristic of the diaphragm 52 is substantially equal to the spring characteristic of the diaphragm 51. On the other hand, the weight of the diaphragm 52 is larger than the weight of the diaphragm 51 by the weight of the resin film 53. As a result, the diaphragms 51 and 52 of the pulsation damper 50 have different characteristic frequencies Fr1, Fr2. That is, the characteristic frequency Fr1 of the diaphragm 51 is larger than the characteristic frequency Fr2 of the diaphragm 52.

Figure 5:
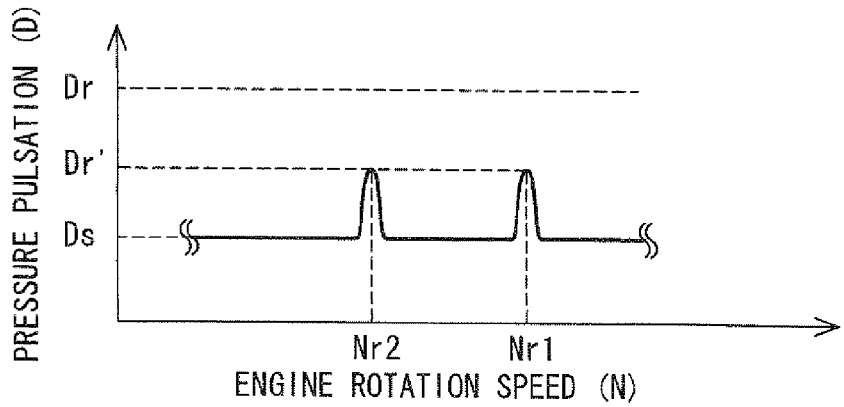
FIG. 5 is a graph showing the relationship between a dimension (D) of a fuel pressure pulsation (i.e., a variation width of the pressure pulsation) in a suction chamber of the fuel pump in the first embodiment, and an engine rotation speed (N)

FIG. 5 is a graph showing the relationship between dimension D (variation width) of the pressure pulsation of the fuel in the suction chamber 300 of the fuel pump 10 and the engine rotational speed (N), according to the first embodiment. As shown in FIG. 5, in a general rotation speed area of the engine, the pulsation is reduced due to the pulsation damper 50, and thereby the pressure pulsation (D) of the fuel in the suction chamber 300 becomes Ds. When the engine rotation speed N is Nr1, the pulsation frequency of the fuel pressure pulsation in the suction chamber 300 becomes the characteristic frequency Fr1 of the diaphragm 51, and resonance of the diaphragm 51 generates. On the other hand, because the diaphragm 52 has normally the reduction effect of the pressure pulsation, the volume change of the pulsation damper 50 is cased due to the diaphragm 52. In the example of FIG. 5, the volume change amount of the pulsation damper 50 is about half as compared with a case without causing the resonance in both the diaphragms 51, 52. Thus, the dimension D of the fuel pressure pulsation becomes D' that is larger than Ds, as shown in FIG. 5. However, the dimension D' of the fuel pulsation is smaller than Dr.

Furthermore, when the engine rotation speed N is Nr2 that is lower than N1, the pulsation frequency of the fuel pressure pulsation in the suction chamber 300 becomes the characteristic frequency Fr2 of the diaphragm 52, and resonance of the diaphragm 52 generates. On the other hand, because the diaphragm 51 has normally the reduction effect of the pressure pulsation, the volume change of the pulsation damper 50 is cased due to the diaphragm 51. In the example of FIG. 5, the volume change amount of the pulsation damper 50 is about half as compared with a case without causing the resonance in both the diaphragms 51, 52. Thus, the dimension D of the fuel pressure pulsation becomes D' that is larger than Ds, as shown in FIG. 5. However, the dimension D' of the fuel pulsation is smaller than Dr by about half of Dr.

According to the fuel pump 10 of the first embodiment, the pulsation damper 50 includes the pair of the diaphragms 51 and 52, and the diaphragm 52 is configured by bonding the resin film 53 as the mass addition member to the diaphragm 51. Thus, the weight of the diaphragm 52 is different from the weight of the diaphragm 51. Thus, when the characteristic frequency of one of the two diaphragm 51 and 52 is equal to the pulsation frequency of the fuel pressure pulsation in the suction chamber 300, the other one of the two diaphragms 51 and 52 does not resonate thereby having the reduction effect in the pressure pulsation. Even in this case, because the other one of the two diaphragms 51 and 52 is used for reducing the pressure pulsation, the pressure pulsation can be reduced by about half as compared with the case shown in FIG. 4. As a result, even when the pulsation frequency of the fuel pressure pulsation in the suction chamber 300 is changed, the reduction effect of the pressure pulsation can be obtained by the pulsation damper 50.

In the fuel pump 10 according to the first embodiment of the present invention, the resin film 53 provided in the diaphragm 52 is made of a resin material having flexibility more than a predetermined degree, while the metal part of the diaphragm 52 is the same as the diaphragm 51. Accordingly, when the diaphragm 52 is elastically deformed by receiving the fuel pressure pulsation, the elastic deformation of the diaphragm 52 is not affected by the resin film 53. As a result, even when the pulsation frequency of the fuel pressure pulsation in the suction chamber 300 becomes equal to any one of the two diaphragms 51 and 52, the variation range and width of the pressure pulsation can be effectively reduced as compared with a case where the two diaphragms have the same characteristic frequency.

In the fuel pump 10 according to the first embodiment of the present invention, a mass addition member such as the resin film 53 is provided in the diaphragm 52 so that the weights of the diaphragms 51, 52 are made different from each other. By changing the weight of the resin film 53 to be bonded, the total weight of the diaphragm 52 can be easily changed, thereby changing the characteristic frequency of the diaphragm 52. As the total weight of the diaphragm 52 becomes larger, the characteristic frequency of the diaphragm 51 is changed to a lower side. Because the resin amount to be used in the resin film 53 can be easily adjusted, the characteristic frequency of the diaphragm 52 can be easily changed in accordance with the dimension and shape of a fuel supply pipe of a vehicle to which the fuel pump 10 is used.

Figure 6:
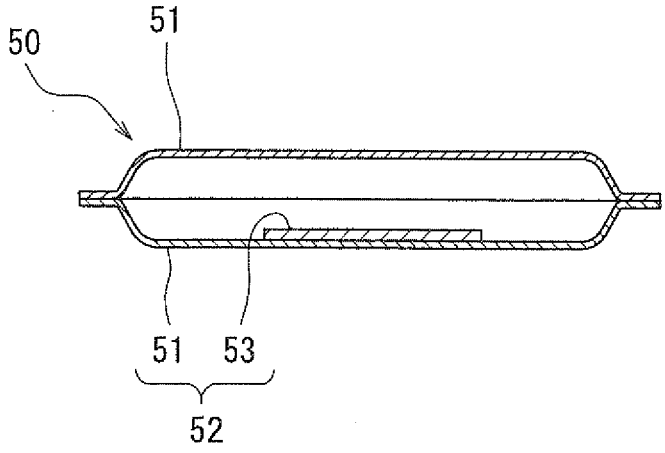
FIG. 6 is a cross sectional view showing a pulsation damper (diaphragm device) of a fuel pump according to a modification example of the first embodiment of the present invention.

In the pulsation damper 50 of the fuel pump 10 according to the first embodiment, the plate 54 is located between the two diaphragms 51 and 52 so that the diaphragms 51 and 52 can be are-tightly fixed to each other via the plate 54. However, the plate 54 for partitioning the inner space of the pulsation damper 50 into the two spaces (312) may be omitted, as shown in FIG. 6. In this case, as shown in FIG. 6, both the diaphragms 51 and 52 are directly welded together to be air-tightly sealed at its outer peripheries.

Second Embodiment

Figure 7:
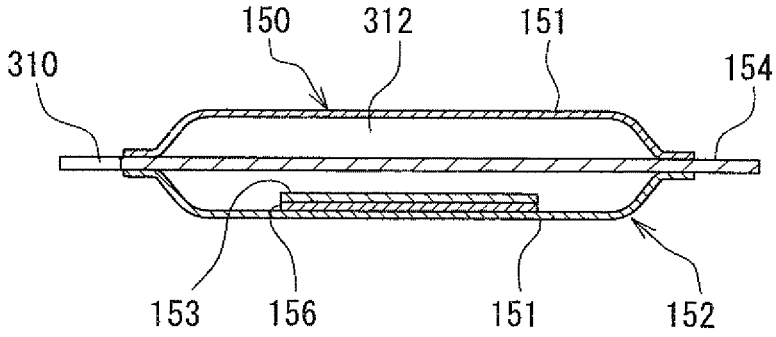
FIG. 7 is a cross sectional view showing a pulsation damper (diaphragm device) of a fuel pump according to a second embodiment of the present invention.

FIG. 7 shows a pulsation damper 150 (diaphragm device) for a fuel pump 10 according to a second embodiment of the present invention.

As shown in FIG. 7, in the pulsation damper 150 of the second embodiment, the structure of the mass addition member attached to one of a pair of diaphragms (151, 151) is changed as compared with the pulsation damper 50 described in the above first embodiment. For example, the mass addition member bonded to an inner surface of the diaphragm 151 is constructed with a flexible metal plate 153 and a bonding material 156 (adhesive) having a suitable flexibility more than a predetermined degree. Next, the structure of the pulsation damper 150 of the fuel pump 10 according to the second embodiment will be described.

The pulsation damper 150 includes two diaphragms 151 and 152, and a plate 154 inserted between the two diaphragms 151 and 152. The bonding structure of the plate 154 between the two diaphragms 151 and 152 is similar to that in the pulsation damper 50 of the first embodiment. The plate 154 has a shape similar to that of the plate 54. The two diaphragms 151 and 152 are constructed of one diaphragm 151, and the diaphragm 152 including another diaphragm 151. Here, the one diaphragm 151 and another diaphragm 151 have the same structure.

The diaphragm 151 is formed by pressing a thin metal plate, similarly to the diaphragm 51 of the first embodiment. The metal thin plate 153 is bonded to an inner surface of another diaphragm 151 via the bonding material 156, to face the plate 154, thereby forming the diaphragm 152. The bonding material 156 has a sufficient flexibility more than a predetermined degree, so as to absorb a relative displacement between another diaphragm 151 and the metal plate 153 in the diaphragm 152, when the two diaphragms 151 and 152 are elastically deformed. Thus, in the diaphragm 152, the elastic deformation of the diaphragm 151 is not affected by the metal plate 153 and the bonding material 156. Therefore, in the second embodiment, the spring characteristic of the diaphragm 152 is substantially equal to the spring characteristic of the diaphragm 151, but the weight of the diaphragm 152 is larger than that of the diaphragm 151 by the weights of the metal plate 153 and the bonding material 156. Accordingly, the characteristic frequency of the diaphragm 152 is lower than the characteristic frequency of the diaphragm 151. As a result, the two diaphragms 151 and 152 of the pulsation damper 150 have different characteristic frequencies.

Accordingly, in the fuel pump 10 according to the second embodiment, when the pulsation frequency of the fuel pressure pulsation in the suction chamber 300 becomes equal to any one of the two diaphragms 151 and 152, the other one of the two diaphragms 151 and 152 does not resonate thereby having the reduction effect of the pressure pulsation. As a result, even when the pulsation frequency of the fuel pressure pulsation in the suction chamber 300 is changed, the reduction effect of the pressure pulsation can be effectively obtained by the pulsation damper 150.

In the fuel pump 10 according to the second embodiment of the present invention, a mass addition member such as the metal plate 153 and the bonding material 156 is provided in the diaphragm 152 so that the weights of the two diaphragms 151, 152 are made different from each other. By using the metal plate 153 that has generally a relative density than larger than resin, the total weight of the diaphragm 52 can be easily increased, thereby easily changing the characteristic frequency of the diaphragm 52. Thus, a difference between the characteristic frequencies of the two diaphragms 151 and 152 can be made easily larger.

In the fuel pump 10 according to the second embodiment of the present invention, the metal plate 153 is bonded on the inside surface of the diaphragm 151 in the diaphragm 152, by using the bonding material 156. However, instead of the bonding material 156, the resin film 53 described in the first embodiment can be used, so that the metal plate 153 is bonded to the inside surface of the diaphragm 151 via the resin film 53.

Figure 8:
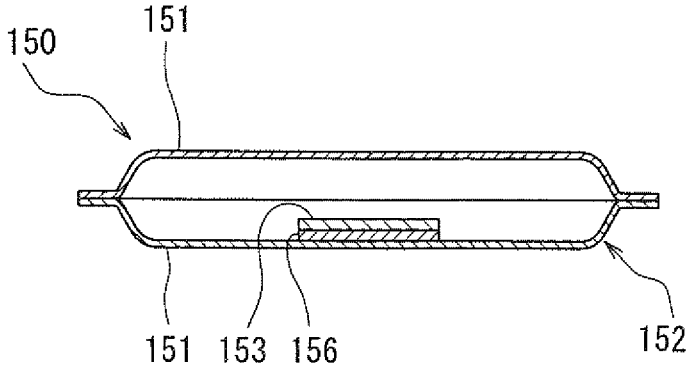
FIG. 8 is a cross sectional view showing a pulsation damper (diaphragm device) of a fuel pump according to a modification example of the second embodiment of the present invention.

In the pulsation damper 150 of the fuel pump 10 according to the second embodiment, the plate 154 is located between the two diaphragms 151 and 152 so that the two diaphragms 151 and 152 can be air-tightly fixed to each other via the plate 154. However, the plate 154 for partitioning the inner space of the pulsation damper 150 into the two spaces may be omitted, as shown in FIG. 8. In this case, as shown in FIG. 8, the two diaphragms 151 and 152 are directly welded together to be air-tightly sealed to each other at its outer peripheries.

In the second embodiment and modification thereof, the other parts of the fuel pump 10 are similar to those of the fuel pump 10 described in the first embodiment.

Third Embodiment

Figure 9:
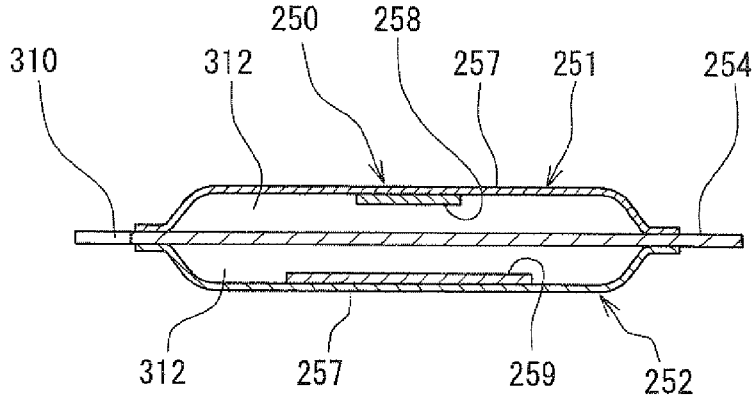
FIG. 9 is a cross sectional view showing a pulsation damper (diaphragm device) of a fuel pump according to a third embodiment of the present invention.

FIG. 9 shows a pulsation damper 250 (diaphragm device) for a fuel pump 10 according to a third embodiment of the present invention.

In the above-described first embodiment, a mass addition member is attached to any one of the two diaphragms. However, in the third embodiment, mass addition members are attached to two diaphragms, respectively. In the third embodiment, the other structure of the fuel pump 10 is similar to that of the fuel pump 10 of the above-described first embodiment. Next, the structure of the pulsation damper 250 of the fuel pump 10 according to the third embodiment will be described.

The pulsation damper 250 includes a diaphragm 251, a diaphragm 252, and a plate 254 inserted between the two diaphragms 251 and 252. The bonding structure of the plate 254 between the two diaphragms 251 and 252 is similar to that of the plate 54 in the pulsation damper 50 of the above-described first embodiment. The plate 254 has a shape similar to that of the plate 54 of the above-described first embodiment. The diaphragm 251 is constructed with one diaphragm 257 and a resin film 258 having a flexibility. The resin film 258 is attached to an inner surface of the one diaphragm 257 to face the plate 254. The diaphragm 257 is formed by pressing a stainless steel plate to have the flexibility, for example.

The diaphragm 252 is constructed with another diaphragm 257 and a resin film 259 having a flexibility. The resin film 259 is attached to an inner surface of another diaphragm 257 to face the plate 254. The resin film 258 and the resin film 259 are made of a resin material, but the weights (attachment amounts) of the resin films 258 and 259 are made different from each other. In the example of FIG. 9, the weight of the resin film 259 is set larger than the weight of the resin film 258. Because the resin films 258 and 259 have sufficient flexibility and the metal parts (diaphragm 257) of the diaphragms 251 and 252 have the same structure, the diaphragms 251 and 252 have the same spring characteristic but have different weights Accordingly, the characteristic frequency of the diaphragm 252 is lower than the characteristic frequency of the diaphragm 251. As a result, the characteristic frequencies of the diaphragms 251 and 252 of the pulsation damper 250 can be made different from each other.

Accordingly, in the fuel pump 10 according to the third embodiment, when the pulsation frequency of the fuel pressure pulsation in the suction chamber 300 becomes equal to any one of the two diaphragms 251 and 252, the other one of the two diaphragms 251 and 252 does not resonate thereby having the reduction effect in the pressure pulsation. As a result, even when the pulsation frequency of the fuel pressure pulsation in the suction chamber 300 is changed, the reduction effect of the pressure pulsation can be effectively obtained by the pulsation damper 250.

In the fuel pump 10 according to the third embodiment of the present invention, the two mass addition members (258, 259) having different weights are respectively attached to a pair of metal diaphragms 257 so as to form the diaphragms 251 and 252 having different characteristic frequencies. Therefore, the pulsation damper 250 can be easily set to be changed only by changing the mass addition members (258, 259) while using the same metal diaphragm 257. Accordingly, the pulsation damper 250 can be used for various-type vehicles to which a fuel pump 10 is mounted, and the product cost of the fuel pump 10 can be reduced.

Figure 10:
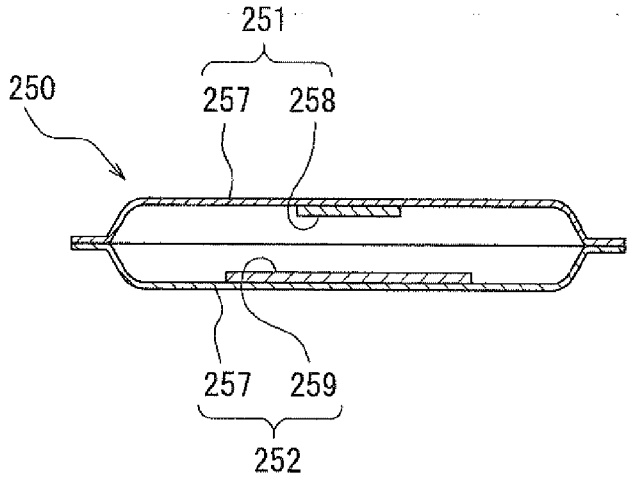
FIG. 10 is a cross sectional view showing a pulsation damper (diaphragm device) of a fuel pump according to a modification example of the third embodiment of the present invention.

In the pulsation damper 250 of the fuel pump 10 according to the third embodiment, the plate 254 is located between the two diaphragms 251 and 252 so that the diaphragms 251 and 252 can be are-tightly fixed to each other via the plate 254. However, the plate 254 for partitioning the inner space of the pulsation damper 250 into the two spaces may be omitted, as shown in FIG. 10. In this case, as shown in FIG. 10, both the diaphragms 251 and 252 are directly welded together to be air-tightly fixed to each other. Thus, the resin films 258 and 259 are opposite to each other, as shown in FIG. 10.

In the third embodiment and modification of the third embodiment, the other parts of the fuel pump 10 are similar to those of the fuel pump 10 described in the first embodiment.

Fourth Embodiment

Figure 11:
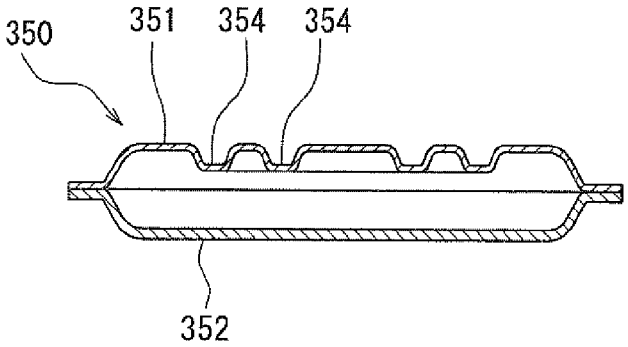
FIG. 11 is a cross sectional view showing a pulsation damper (diaphragm device) of a fuel pump according to a fourth embodiment of the present invention.

A fourth embodiment and a modification of the fourth embodiment according to the present invention will be described with reference to FIGS. 11 and 12. FIG. 11 shows a pulsation damper 350 (diaphragm device) for a fuel pump 10 according to the fourth embodiment.

In the above-described embodiments the mass addition member is attached to at least one of the two diaphragms so that the two diaphragms have different characteristic frequencies. However, in the example of FIG. 11, the pulsation damper 350 is configured without using a mass addition member described in the above embodiments. Next, the structure of the pulsation damper 350 for the fuel pump 10 according to the fourth embodiment will be described in detail.

The pulsation damper 350 is constructed with two metal diaphragms 351 and 352 which are welded at its outer periphery. Each of the diaphragms 351 and 352 is formed by pressing a stainless steel plate to have a circular deformable portion and an outer peripheral portion at a radial outside of the circular deformable portion. As shown in FIG. 11, the cross sectional shapes of the diaphragms 351 and 352 are made to be different from each other. The diaphragm 352 is formed so that the circular deformable portion of the diaphragm 352 has a flat shape with a straight line in the cross-section. In contrast, the circular deformable portion of the diaphragm 351 has a wave shape in cross section with a plurality of concavities and convexities. For example, plural concentric circular grooves 354 (e.g., two concentric circular grooves in the example of FIG. 11) are formed by pressing, so as to form concavities and convexities in the diaphragm 351. Therefore, the strength of the diaphragm 351 is larger than that of the diaphragm 352, and thereby the characteristic frequency of the diaphragm 351 becomes smaller than the characteristic frequency of the diaphragm 352. Thus, the characteristic frequencies of the two diaphragms 351 and 352 of the pulsation damper 350 can be made to be different from each other.

Because the diaphragm 352 is similar to the diaphragm 51, 151, the diaphragm 352 can be easily formed. In contrast, the diaphragm 351 is formed with the plural concentric circular grooves 354, the diaphragm 351 can be easily formed by pressing such as punching or the like.

Accordingly, in the fuel pump 10 according to the fourth embodiment, when the pulsation frequency of the fuel pressure pulsation in the suction chamber 300 becomes equal to any one of the two diaphragms 351 and 352, the other one of the two diaphragms 351 and 352 does not resonate thereby having the reduction effect of the pressure pulsation. As a result, even when the pulsation frequency of the fuel pressure pulsation in the suction chamber 300 is changed, the reduction effect of the pressure pulsation can be effectively obtained by the pulsation damper 350.

In the pulsation damper 350, the wave shape of the diaphragm 351 in cross section may be suitably changed without being limited to the shape shown in FIG. 11.

In the pulsation damper 350 of the fourth embodiment shown in FIG. 11, a mass addition member is not attached to any diaphragm 351, 352. However, as shown in FIG. 12, a resin film 353 as a mass addition member may be attached to an inside surface of the flat portion of the diaphragm 352.

Figure 12:
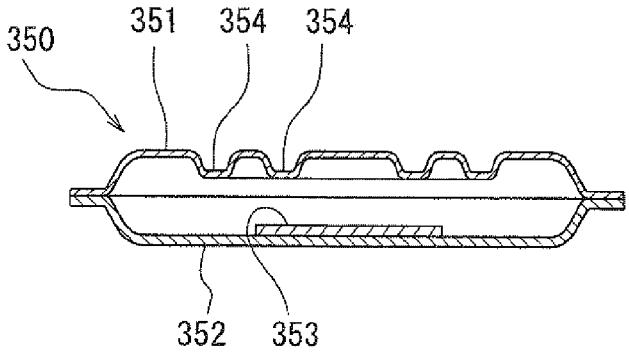
FIG. 12 is a cross sectional view showing a pulsation damper (diaphragm device) of a fuel pump according to a modification example of the fourth embodiment of the present invention.

In the examples of FIGS. 11 and 12, a plate for partitioning an inner space of the pulsation damper 350 is not provided between the two diaphragms 351 and 352. However, a plate may be disposed between the two diaphragms 351 and 352, similarly to the plate 54 described in the first embodiment.

Fifth Embodiment

Figure 13:
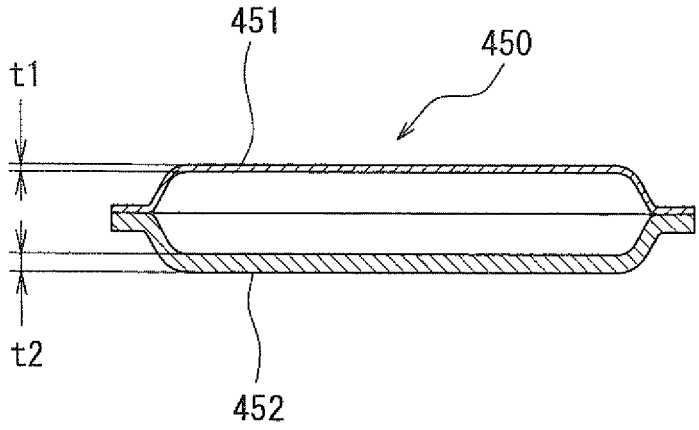
FIG. 13 is a cross sectional view showing a pulsation damper (diaphragm device) of a fuel pump according to a fifth embodiment of the present invention.

A fifth embodiment and a modification thereof according to the present invention will be described with reference to FIGS. 13 and 14. FIG. 13 shows an example of a pulsation damper 450 (diaphragm device) for a fuel pump 10 according to the fifth embodiment.

As shown in FIG. 13, the pulsation damper 450 of the fifth embodiment includes two diaphragms 451 and 452 which are different from each other in the thickness while having the same outer shape. The pulsation damper 450 is configured without using a mass addition member. The two diaphragms 451 and 452 are welded directly at its periphery to be opposite with each other, without using a plate therebetween. Next, the structure of the pulsation damper 450 for the fuel pump 10 according to the fifth embodiment will be described.

The entire outer peripheries of the diaphragms 451 and 452 having different thicknesses are air-tightly welded to each other so as to form the pulsation damper 450. The diaphragm 452 has a thickness t2 that is larger than a thickness t1 of the diaphragm 451. That is, t1<t2. Thus, the characteristic frequency of the diaphragm 451 can be made larger than the characteristic frequency of the diaphragm 452. Thus, the characteristic frequencies of the two diaphragms 451 and 452 of the pulsation damper 450 can be made to be different from each other.

Accordingly, in the fuel pump 10 according to the fifth embodiment, when the pulsation frequency of the fuel pressure pulsation in the suction chamber 300 becomes equal to any one of the two diaphragms 451 and 452, the other one of the two diaphragms 451 and 452 does not resonate, thereby having the reduction effect of the pressure pulsation. As a result, even when the pulsation frequency of the fuel pressure pulsation in the suction chamber 300 is changed, the reduction effect of the pressure pulsation can be effectively obtained by the pulsation damper 450.

In the pulsation damper 450 of the fifth embodiment shown in FIG. 13, a mass addition member is not attached to any diaphragm 451, 452. However, as shown in FIG. 14, a resin film 453 as a mass addition member may be attached to an inside surface of the flat portion of the diaphragm 452.

Figure 14:
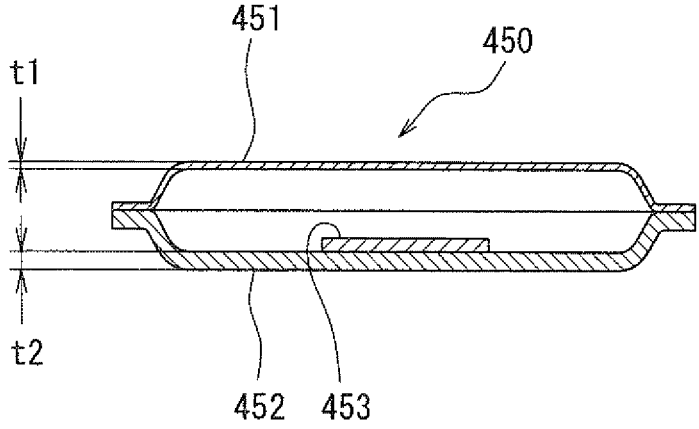
FIG. 14 is a cross sectional view showing a pulsation damper (diaphragm device) of a fuel pump according to a modification example of the fifth embodiment of the present invention.

In the examples of FIGS. 13 and 14, a plate for partitioning an inner space of the pulsation damper 450 is not provided between the two diaphragms 451 and 452. However, a plate may be disposed between the two diaphragms 451 and 452, similarly to the plate 54 described in the first embodiment, for example.

Although the present invention has been fully described in connection with the preferred embodiments thereof with reference to the accompanying drawings, it is to be noted that various changes and modifications will become apparent to those skilled in the art.

For example, in the above-described embodiments, the film (53, 153, 156, 258, 259, 353, 453) may be made of any material having flexibility equal to or more than a predetermined degree, without being limited to the metal or the resin described in the above embodiments. Here, the predetermined degree of the flexibility is set such that the film (53, 153, 156, 258, 259, 353, 453) substantially does not affect the spring characteristic of the diaphragms.

Such changes and modifications are to be understood as being within the scope of the present invention as defined by the appended claims.

What is claimed is:

1. A fuel pump comprising:

a housing having therein a suction passage through which fuel is drawn, and a pressurization chamber into which the fuel from the suction passage flows;

a plunger held in the housing to be reciprocable, the plunger being configured to pressurize the fuel flowing into the pressurization chamber;

a diaphragm device located in a suction chamber that is provided in the suction passage, wherein the diaphragm device includes a pair of first and second diaphragms that are arranged to define an inner space therebetween and air-tightly sealed at its entire peripheries, the first and second diaphragms are made of metal, and generally have the same shape and the same thickness, and the first and second diaphragms each have an inside surface portion, the inside surface portions are disposed to oppose each other and spaced apart from each other by the inner space; and a mass addition member attached to the inside surface portion of one of the first and second diaphragms, wherein the mass addition member is a flat, planar member, and the mass addition member is spaced from the inside surface portion of the other of the first and second diaphragms.

2. The fuel pump according to claim 1, wherein the mass addition member is made of a material having flexibility, said material being one of a resin film and a thin metal plate.

3. The fuel pump according to claim 1, wherein the mass addition member is a metal film that is bonded to said inside surface portion via a flexible adhesive.

4. The fuel pump according to claim 1, wherein the mass addition member is attached to the inside surface of the second diaphragm to be integrated to each other such that a total characteristic frequency of the second diaphragm and the mass addition member is different from that of the first diaphragm.

5. The fuel pump according to claim 1, further comprising a plate located between the first and second diaphragms to partition the inner space into two space parts.

6. The fuel pump according to claim 1, wherein the mass addition member is attached to said inside surface portion of said one of the first and second diaphragms with an adhesive.

7. The fuel pump according to claim 1, wherein the mass addition member is attached to said inside surface portion so as to be spaced apart from said air-tightly sealed periphery.

8. The fuel pump according to claim 1, wherein the mass addition member is disposed substantially in parallel with the inside surface portion of the other of the first and second diaphragms.

9. The fuel pump according to claim 1, wherein the mass addition member is positioned without being exposed to the fuel.

10. A fuel pump comprising:

a housing having therein a suction passage through which fuel is drawn, and a pressurization chamber into which the fuel from the suction passage flows;

a plunger held in the housing to be reciprocable, the plunger being configured to pressurize the fuel flowing into the pressurization chamber;

a diaphragm device located in a suction chamber that is provided in the suction passage, wherein the diaphragm device includes a pair of first and second diaphragms that are arranged to define an inner space therebetween and are air-tightly sealed at its entire peripheries, the first and second diaphragms are made of metal, and generally have the same thickness while having different shapes in cross section, and the first and second diaphragms each have an inside surface portion, the inside surface portions are disposed to oppose each other and spaced apart from each other by the inner space; and a mass addition member attached to the inside surface portion of one of the first and second diaphragms, wherein the mass addition member is a flat, planar member, and the mass addition member is spaced from the inside surface portion of the other of the first and second diaphragms.

11. The fuel pump according to claim 10, wherein the first diaphragm has a circular deformable portion and a peripheral end portion at a radial outside of the circular deformable portion, and the circular deformable portion of the first diaphragm has a plurality of concentric grooves that are recessed toward the inner space of the diaphragm device, so as to have a wave shape in cross section.

12. The fuel pump according to claim 11, wherein the second diaphragm has a circular deformable portion and a peripheral end portion at a radial outside of the circular deformable portion, and the circular deformable portion of the second diaphragm has a flat shape in cross section.

13. The fuel pump according to claim 10, wherein the mass addition member is made of a material having flexibility, said material being one of a resin film and a thin metal plate.

14. The fuel pump according to claim 10, wherein the mass addition member is a metal film that is bonded to said inside surface portion via a flexible adhesive.

15. The fuel pump according to claim 10, wherein the first and second diaphragms are configured to have characteristic frequencies different from each other.

16. The fuel pump according to claim 10, wherein the mass addition member is attached to said inside surface portion so as to be spaced apart from said air-tightly sealed periphery.

17. The fuel pump according to claim 10, wherein the mass addition member is disposed substantially in parallel with the inside surface portion of the other of the first and second diaphragms.

18. The fuel pump according to claim 10, wherein the mass addition member is positioned without being exposed to the fuel.

19. A fuel pump comprising:

a housing having therein a suction passage through which fuel is drawn, and a pressurization chamber into which the fuel from the suction passage flows;

a plunger held in the housing to be reciprocable, the plunger being configured to pressurize the fuel flowing into the pressurization chamber;

a diaphragm device located in a suction chamber that is provided in the suction passage, wherein the diaphragm device includes a pair of first and second diaphragms that are arranged to define an inner space therebetween and are air-tightly sealed at its entire peripheries, the first and second diaphragms generally have different thicknesses in cross section, while having the same outer shape, and the first and second diaphragms each have an inside surface portion, the inside surface portions are disposed to oppose each other and spaced apart from each other by the inner space;

a first mass addition member attached to the inside surface portion of one of the first and second diaphragms, and a second mass addition member attached to the inside surface portion of the other of the first and second diaphragms, wherein the first and second mass addition members are both flat, planar members that are different from one another in size, and the first and second mass addition members are spaced apart from one another.

20. The fuel pump according to claim 19, wherein each of the first and second diaphragms has a circular deformable portion and a peripheral end portion at a radial outside of the circular deformable portion, and the circular deformable portion of each of the first and second diaphragms has a flat shape in cross section.

21. The fuel pump according to claim 19, wherein the first and second mass addition members are each made of a material having flexibility, said material being one of a resin film and a thin metal plate.

22. The fuel pump according to claim 19, wherein at least one of the mass addition members is a metal film that is bonded to said inside surface portion via a flexible adhesive.

23. The fuel pump according to claim 19, wherein the first and second diaphragms are configured to have characteristic frequencies different from each other.

24. The fuel pump according to claim 19, wherein at least one of the first and second mass addition members is attached to said inside surface portion so as to be spaced apart from said air-tightly sealed periphery.

25. The fuel pump according to claim 19, wherein the first and second mass addition members are each positioned without being exposed to the fuel.

* * * * *